United States Patent [19]

Büll

[11] Patent Number: 4,737,051

[45] Date of Patent: Apr. 12, 1988

[54] MOBILE MINE-ROOF SUPPORT

[75] Inventor: Hans Büll, Wuppertal, Fed. Rep. of Germany

[73] Assignee: Hermann Hemscheidt Maschinenfabrik GmbH & Co., Fed. Rep. of Germany

[21] Appl. No.: 1,495

[22] Filed: Dec. 5, 1986

[30] Foreign Application Priority Data

Dec. 5, 1985 [DE] Fed. Rep. of Germany ..... 3543060

[51] Int. Cl.[4] ..... E21D 15/44; E21D 23/00

[52] U.S. Cl. ..... 405/291; 405/298

[58] Field of Search ..... 405/291–301; 299/31, 33

[56] References Cited

U.S. PATENT DOCUMENTS

| | | | |
|---|---|---|---|
| 2,899,800 | 8/1959 | Joy | 405/298 |
| 3,448,584 | 6/1969 | Rieschel | 405/299 |
| 4,155,675 | 5/1979 | Friedrichs | 405/293 X |
| 4,348,138 | 9/1982 | Blampain et al. | 405/297 |
| 4,613,256 | 9/1986 | Zitz et al. | 405/291 X |

FOREIGN PATENT DOCUMENTS

| | | | |
|---|---|---|---|
| 543208 | 12/1955 | Belgium | 405/291 |
| 3111568 | 4/1982 | Fed. Rep. of Germany | 405/291 |

*Primary Examiner*—Dennis L. Taylor

*Attorney, Agent, or Firm*—Berman, Aisenberg & Platt

[57] ABSTRACT

A mobile mine-roof support comprises a powered track-laying carriage having a carrier shaft extending longitudinally of the carriage between its tracks, the end portions of the carrier shaft being arranged to support mountings of bracket form for props supporting a roof beam which is stabilized by a lemniscate guide linkage the floorward links of which ar articulated to an attachment part or extension of one of the prop mountings, with stabilization of the laterally-pivotable props being effected by an orienting cylinder supported on the chassis.

7 Claims, 4 Drawing Sheets

MOBILE MINE-ROOF SUPPORT

This invention relates to a mobile mine-roof support for use in mine workings.

DE-A-11 39 084 describes a mobile mine-roof support having a chassis which is provided with caterpiller tracks and which forms a base or abutment for a forward prop and a rear prop arranged to support, in an articulated manner, a roof beam which abuts against the roof of a mine. The track-laying carriage can be driven by an hydraulic motor through sprocket wheels mounted on the carriage. The props are arranged between the skids of the chassis and are supported approximately at axle level by tube ends of domed formation on mountings on the chassis. A rigid link which is articulated to the chassis at floor level through a simple pivot joint spindle and to the roof beam at roof level through a cardan joint serves to stabilise the support but only for a limited range of height adjustment. This form of support achieves high mobility with the track-laying carriage but, with only two props, the supporting force is inadequate. In addition, the props and the rigid link are pivotable to only a small extent in relation to the carriage so that even slight irregularities of the mine floor lead to the support taking up an oblique position. Only the roof beam can adapt well to surface irregularities, and this is due to the cardan joint connection between the link and the beam. When therefore the carriage is standing on an inclined mine floor, the resultant of the support force extending perpendicularly through the roof beam mounting passes outside the floor-side support area of the carriage so that the already top-heavy mine-roof support threatens to tip over.

It is also known from DE-A-27 29 564 to provide a walking mine-roof support in which props arranged in V-formation in the walking direction are articulatedly mounted on a floor skid and articulatedly support a roof beam. The roof beam is stabilised in relation to the floor skid by two links and a rocker of a lemniscate guide system. One of the links is an hydraulically-shiftable lifting cylinder which takes up thrust forces acting from the roof and does not transmit them to the support chassis.

From DE-A-23 09 671 it is further known to mount the two links of a walking shield-type mine-roof support so thay they are laterally pivotable on joints with longitudinally-directed axes extending in the walking direction. The props are supported directly on the floor skid of the support and are stabilised thereon by laterally-acting hydraulic aligning cylinders which therefore act transversely of the walking direction. The roof beam of the mine-roof support is mounted by means of a cardan joint for the transmission of the support forces.

In DE-A-27 27 655 there is a description of a carriage for a mine-roof support wherein two caterpillar tracks are swivellably connected through bearing journals extending in the longitudinal direction of the support to transverse girders of cantilever form comprising part of the carriage chassis. The transverse girders are secured to a centrally-arranged longitudinal girder on which two props are set up one behind the other. In travelling over irregularities in the floor of the mine, the tracks can pivot in relation to one another and in relation to the longitudinal girder only about the rotation axes extending in the longitudinal direction. If the chassis is set obliquely, then the props too are pivoted into a lateral oblique position.

The chassis of the mine-roof support described in DE-A-34 44 187 forms a mounting for four rectangularly-arranged props and for a lemniscate guide system for the stabilisation of an articulatedly-supported roof beam. The two floor-level links of the lemniscate guide system, of which the forward one is hydraulically adjustable in length, are articulated to a pivot frame which is mounted so as to be laterally pivotable with a joint axis extending in the longitudinally direction of the support on the chassis and being laterally supported by aligning cylinders supported thereon. However, oblique positions of the carriage are compensated to only a limited extent by the articulated mountings of the props. The mounting of the props on the carriage reduces the range of length adjustment and increases the transport height of the support.

The aim of the present invention is to provide a mobile mine-roof support which is an improvement over all the prior construction described above and which is mobile on a track-laying vehicle so that the props have a relatively large range of length adjustment and largely retain their predetermined basic position, (i.e., substantially perpendicular to the seam) even in the case of lateral oblique positions of the carriage.

With this aim in view, the invention is directed to a mobile mine-roof support for use in mine workings comprising a track-laying carriage having a chassis which forms an abutment or base for hydraulically height-adjustable props articulatedly mounted at its forward and rear regions for the articulated support of a roof beam which is guided with respect to the chassis by the links of a lemniscate guide linkage having an hydraulic length-adjustable link, the linkage being pivotably mounted for lateral swinging movement on the chassis and being stabilised by a laterally-acting orienting cylinder articulated to the carriage, in which the props are pivotably supported for lateral swinging movement on a carrier shaft which is mounted on the chassis and which extends longitudinally of the mine-roof support between the tracks of the carriage.

The carrier shaft mounted on the chassis between the tracks forms a central pivot bearing on which all support elements of the mine-roof support which do not pertain to the track-laying carriage are laterally pivotably supported. Accordingly, in travelling over surface irregularities, the carriage can take up lateral oblique positions without the props being pivoted out of their predetermined stable positions. The support thereby retains a full support force for the mine roof while retaining its stability during driving movement. The mountings of the props on the carriage also lie at a comparatively low level. so that the possible range of length adjustment of the props can be exploited to nearly their full extent even when the carriage is tilted laterally.

An example of a mobile mine-roof support in accordance with the invention is shown in the accompanying drawings, wherein—

Figure 1:
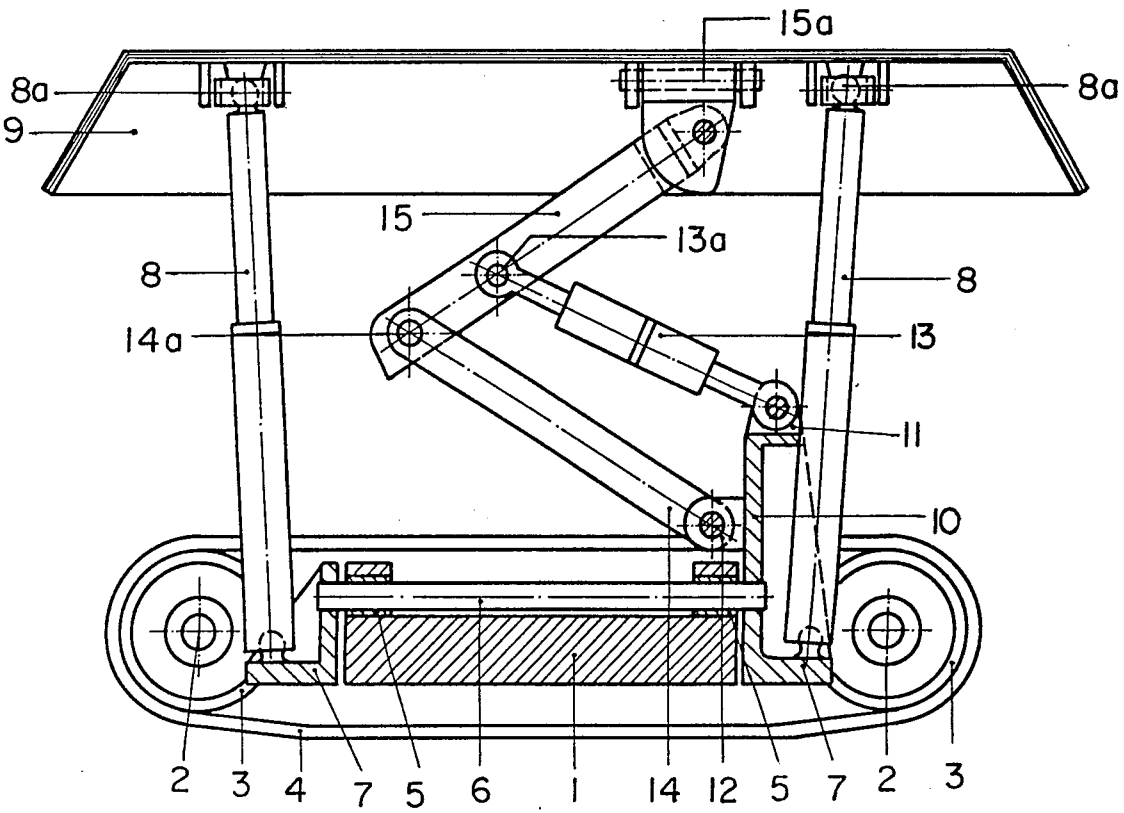
FIG. 1 is a part-sectional side view of the mobile mine-roof support.
Figure 2:
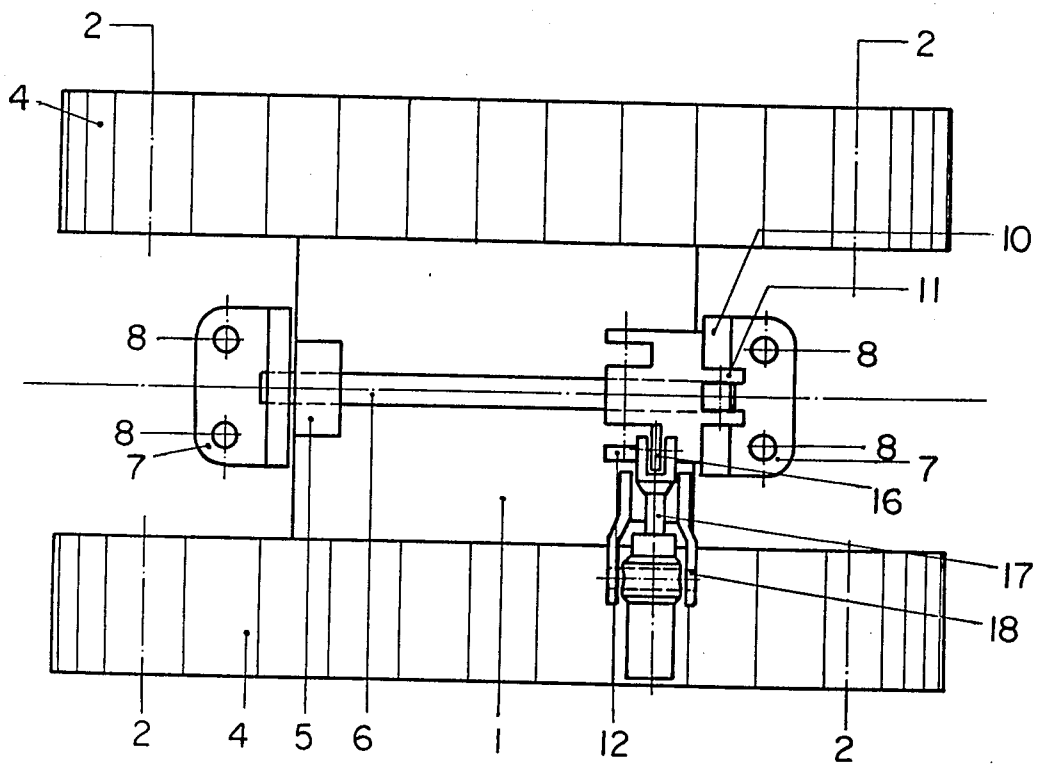
FIG. 2 is a plan view of the carriage of the support.
Figure 3:
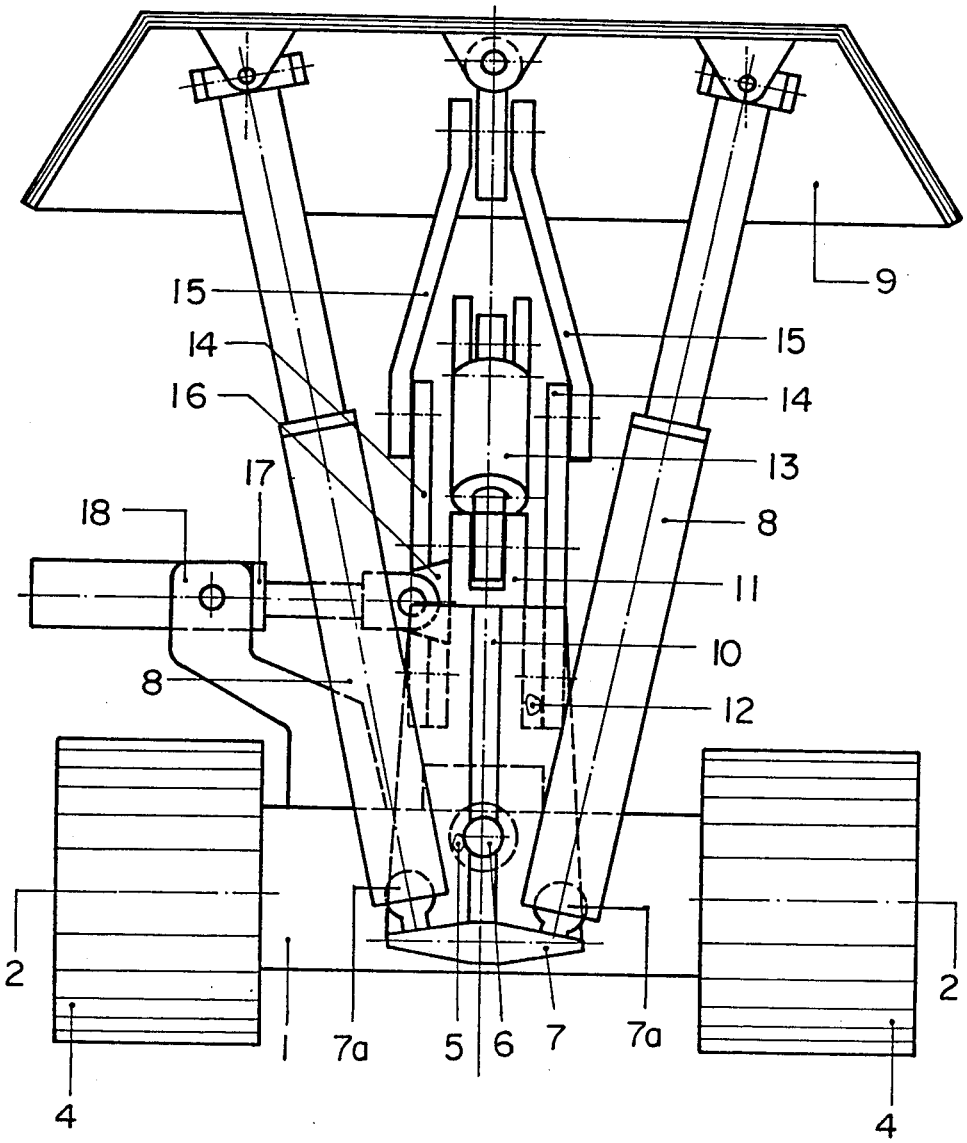
FIG. 3 is a front view of the support.

The mobile mine-roof support shown in the drawings comprises a track-laying carriage having a chassis 1 which is supported on front and rear axles 2 each provided with externally-arranged sprocket wheels 3 driven by hydraulic motors (not shown). Respective endless caterpillar tracks 4 rolling on the mine floor are guided over the sprocket wheels 3.

On the chassis 1 there are forward and rear axle bearings 5 for the rotatable mounting of a carrier shaft 6 which extends longitudinally of the mine-roof support mid-way between the tracks 4. Bracket-type mountings 7 for four props 8 of the support are suspended on or otherwise secured to the respective end portions of the carrier shaft 6 which lies above the upper surface of the chassis 1, the prop mountings 7 being arranged approximately at axle height of the carriage to preserve the necessary ground clearance. In the example shown, two height-adjustable hydraulically-operated props 8 are articulatedly mounted in V-formation (i.e., at an inclination in relation to one another) on two ball-shaped studs 7*a* on each of the two prop mountings 7. At roof level, a roof beam 9 is pivotally supported on the upper ends of the props 8 through cardan joints 8*a*.

Figure 4:
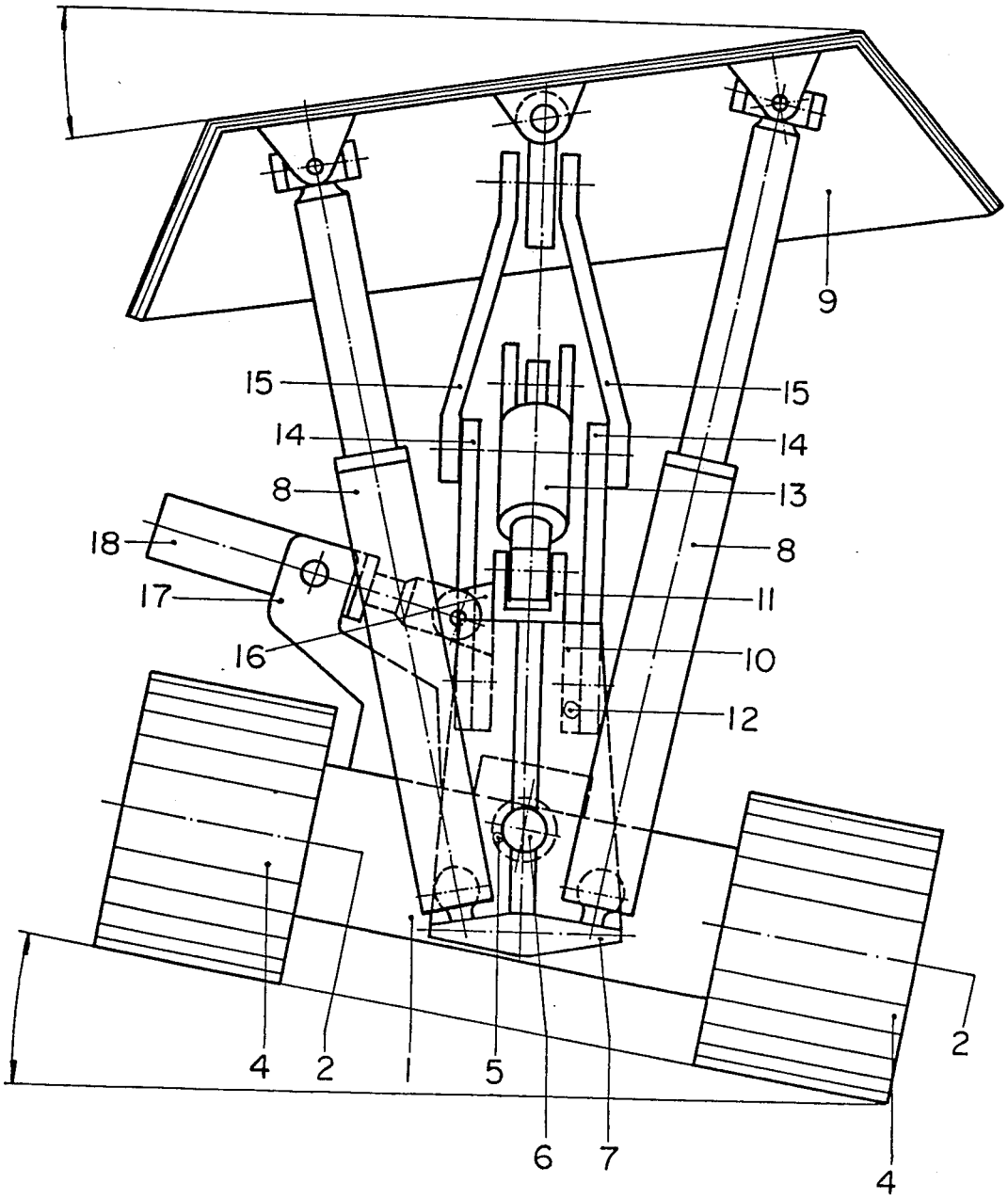
FIG. 4 is a view similar to FIG. 3 but with the carriage tilted in one direction and the roof beam tilted in the opposite direction.

One of the prop mountings 7 includes an attachment part or extension 10 to which two joint heads 11 and 12 for a lemniscate guide linkage composed of two links 13 and 14 and a rocker lever 15 are pivotally connected. A joint head 16 for an hydraulic orienting cylinder 7 is also secured to a side part of the attachment part 10 as shown in FIG. 4. The two links 13 and 14 are mounted one above the other with their ends remote from the joint heads 11 and 12 pivotally connected at spaced-apart points 13*a* and 14*a* to a rocker lever 15 the upper end of which is connected at roof level through a cardan joint 15*a* to the roof beam 9. The forward or upper link 13 is formed as an hydraulically-actuatable double-acting piston-and-cylinder link. The roof beam 9 supported by the props 8 is stabilised in the vertical direction by the lemniscate guide linkage, with thrust movements of the roof being compensated by the hydraulic link 13.

The props 8, the roof beam 9 and the lemniscate guide linkage 13, 14, 15 are pivotably supported for lateral swinging movement by the carrier shaft 6 on the track-laying carriage 1 to 5. In this way the track-laying carriage, in travelling over irregularities in the mine floor, can readily take up inclined or tilted positions without the props 8, or their resultant forces in the case of a V-shaped arrangement like that shown, pivoting out of a predetermined position substantially perpendicular to the seam. The hydraulic orienting cylinder 17 which is pivotally mounted on a support bracket 18 connected to the chassis 1 and which is pivotally attached to the joint head 16 of the attachment part 10 is provided for the stabilisation and correction of the lateral pivotal position of the support elements 7 to 15 pivotably supported on the carrier shaft 6.

I claim:

1. A mobile mine-roof support for use in mine workings comprising a track-laying carriage having at least two tracks and having a chassis forming a base, a plurality of hydraulically height-adjustable props articulatedly mounted at forward and rear regions of the chassis, a roof beam articulated to upper portions of the props, a lemniscate guide linkage pivotally mounted on the chassis for lateral swinging movement to guide the roof beam with respect to the chassis, the linkage having a hydraulic length-adjustable link, a laterally-acting orienting cylinder articulated to the carriage and connected to the guide linkage to stabilise the guide linkage, and a carrier shaft mounted on the chassis and extending longitudinally of the mine-roof support between the tracks of the carriage, the props being pivotally supported for lateral swinging movement on the carrier shaft.

2. A mobile mine-roof support according to claim 1, in which mountings of bracket form for the props are secured to end portions of the carrier shaft.

3. A mobile mine-roof support according to claim 2, in which the bracket-form prop mountings are suspended from the carrier shaft approximately at axle height of the carriage.

4. A mobile mine-roof support according to claim 1, in which two props inclined to each other in V-formation are supported on each mounting.

5. A mobile mine-roof support according to claim 1, in which the carrier shaft is supported in two bearings on the chassis.

6. A mobile mine-roof support according to claim 1, in which links of the lemniscate guide linkage are secured by pivotal joints to an attachment part of one of the prop mountings

7. A mobile mine-roof support according to claim 6, in which the orienting cylinder is supported by a support bracket on the chassis and acts through a pivotal joint on the attachment part of the said prop mounting.

* * * * *